US007180459B2

(12) United States Patent
Balaji et al.

(10) Patent No.: US 7,180,459 B2
(45) Date of Patent: Feb. 20, 2007

(54) MULTIPLE PHASE CENTER FEEDHORN FOR REFLECTOR ANTENNA

(75) Inventors: Bhashyam Balaji, Ottawa (CA); Anthony Damini, Ottawa (CA); George E. Haslam, Ottawa (CA); Lotfollah Shafai, Winnipeg (CA); Satish Sharma, Winnipeg (CA)

(73) Assignee: Her Majesty the Queen in right of Canada, as represented by the Minister of National Defence of Her Majesty' Canadian Government, Ottawa (CA)

( * ) Notice: Subject to any disclaimer, the term of this patent is extended or adjusted under 35 U.S.C. 154(b) by 0 days.

(21) Appl. No.: 10/869,844

(22) Filed: Jun. 18, 2004

(65) Prior Publication Data

US 2005/0007287 A1 Jan. 13, 2005

Related U.S. Application Data

(60) Provisional application No. 60/480,742, filed on Jun. 24, 2003.

(51) Int. Cl.
*H01Q 13/00* (2006.01)

(52) U.S. Cl. ..... 343/786

(58) Field of Classification Search ..... 343/772, 343/781 R, 786

See application file for complete search history.

(56) References Cited

U.S. PATENT DOCUMENTS

| | | | | | |
|---|---|---|---|---|---|
| 3,624,655 | A | * | 11/1971 | Sato et al. | 343/756 |
| 4,420,756 | A | * | 12/1983 | Hamada et al. | 342/153 |
| 4,673,943 | A | * | 6/1987 | Hannan | 342/367 |
| 4,697,188 | A | * | 9/1987 | Lin | 342/383 |
| 4,742,317 | A | * | 5/1988 | Thal, Jr. | 333/137 |
| 4,774,520 | A | * | 9/1988 | Bouko et al. | 343/783 |
| 5,142,290 | A | * | 8/1992 | DuFort | 342/372 |
| 5,402,089 | A | * | 3/1995 | Tsuda et al. | 333/113 |
| 5,410,318 | A | * | 4/1995 | Wong et al. | 342/359 |
| 5,617,108 | A | * | 4/1997 | Silinsky et al. | 343/786 |
| 5,793,334 | A | * | 8/1998 | Anderson et al. | 343/786 |
| 5,821,906 | A | * | 10/1998 | Campan | 343/786 |

OTHER PUBLICATIONS

Damini et al; "Novel multiple phase centre reflector antenna for GMTI radar"; IEE Proc., Antennas Propag.; vol. 151, No. 3, Jun. 2004; pp. 199-204.

* cited by examiner

*Primary Examiner*—Tan Ho
*Assistant Examiner*—Leith A Al-Nazer
(74) *Attorney, Agent, or Firm*—Stites & Harbison, PLLC; Ross F. Hunt, Jr.

(57) ABSTRACT

A feedhorn driving method and apparatus allows the establishment of multiple phase centers using only a single multimode feedhorn. At least two higher-order modes are extracted from the feedhorn and weighted in amplitude and phase. The phase center separation is established in accordance with an assigned weights. The feedhorn has application in i.a. moving target indication systems.

5 Claims, 4 Drawing Sheets

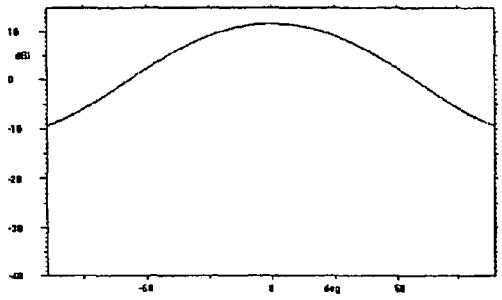
FIG. 3-A
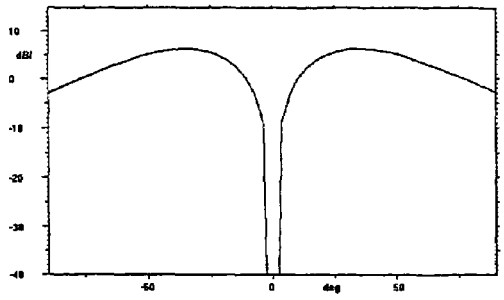
FIG. 3-B
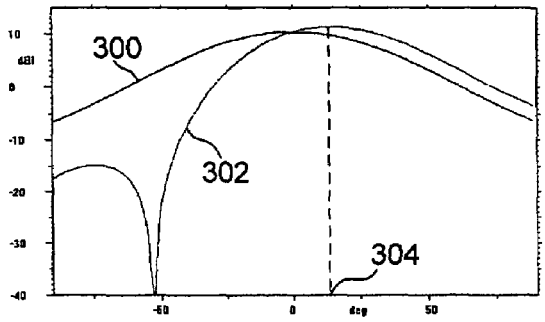
FIG. 3-C
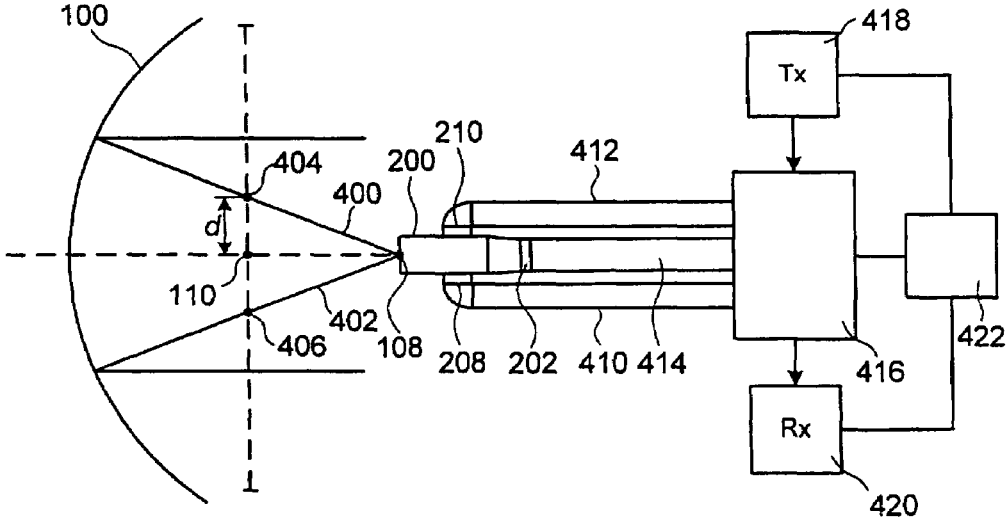
FIG. 4

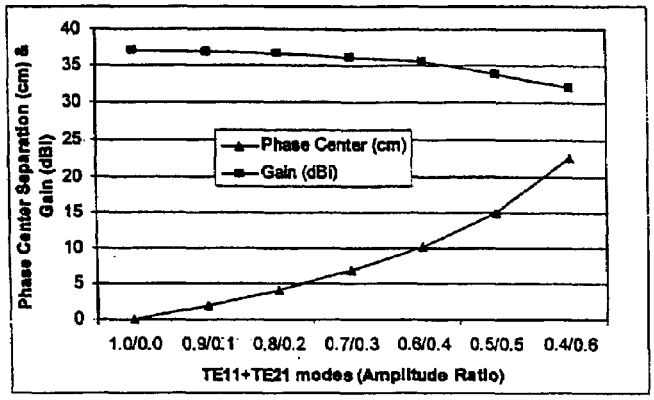
FIG. 5
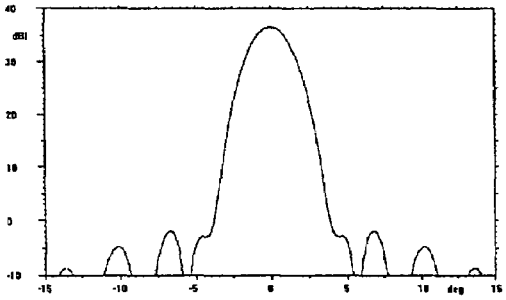
FIG. 6-A
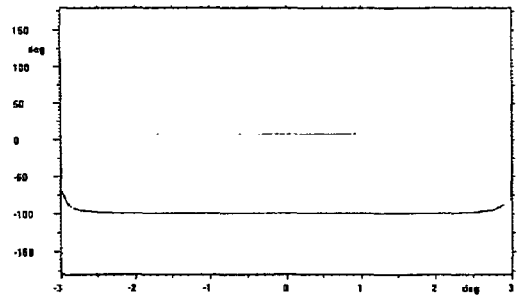
FIG. 6-B
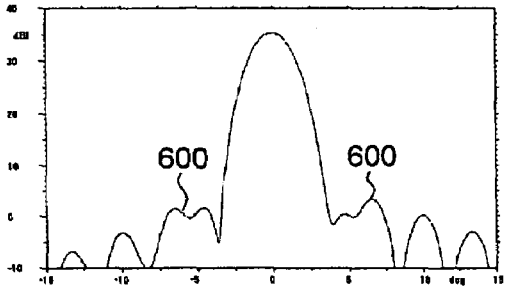
FIG. 6-C
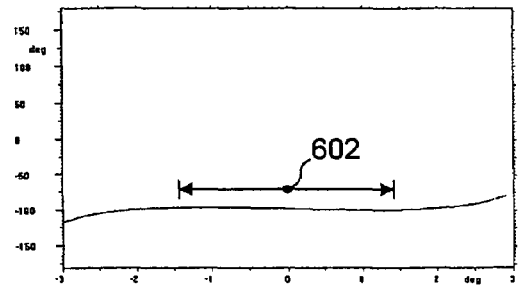
FIG. 6-D

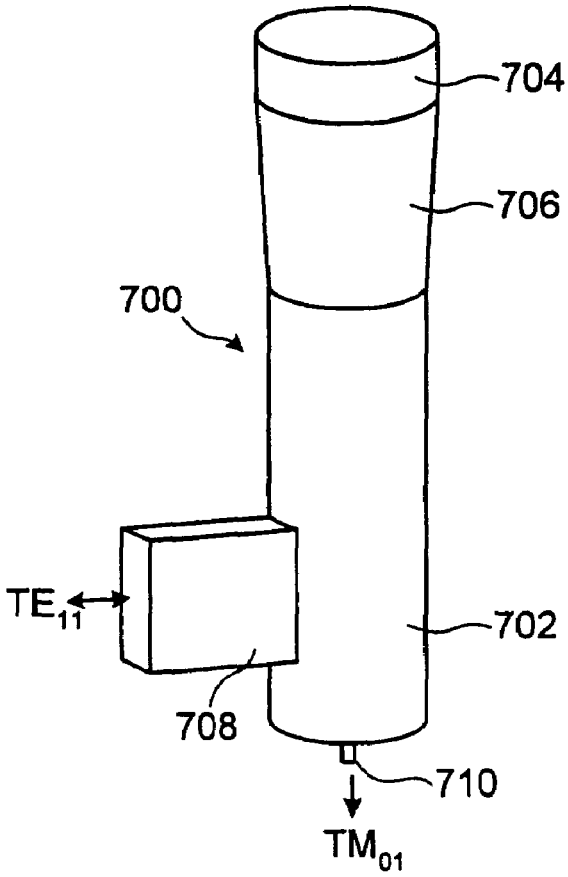
FIG. 7-A
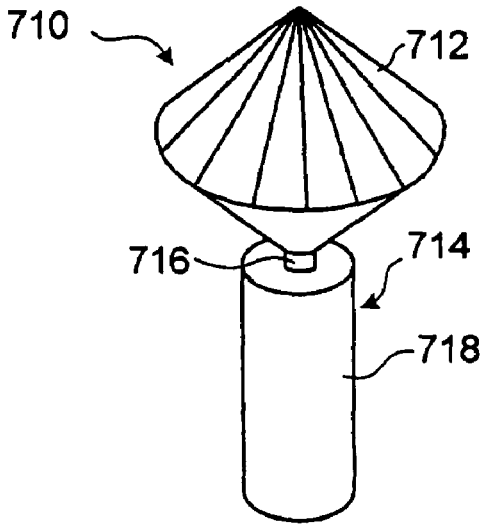
FIG. 7-B

MULTIPLE PHASE CENTER FEEDHORN FOR REFLECTOR ANTENNA

This application claims benefit of the filing date of U.S. Provisional Application No. 60/480,742 filed on Jun. 24, 2003.

BACKGROUND OF THE INVENTION

The invention relates generally to radio wave antennae, and more particularly to multiple phase center radio wave antennae.

Multiple phase center antennae are used in some specialized communications and radar applications. Specific radar applications may include ground or airborne moving target indication (MTI), along with track interferometry and maritime surveillance. In MTI systems it may become difficult to discern a target from stationary background clutter when the target is moving slowly with respect to the terrain. Clutter is the term used in radar applications, to describe confusing or unwanted reflections that interfere with the observation of desired signals on a radar indicator. Clutter may be suppressed by receiving reflected radiation beams via multiple radar channels and employing adaptive filtering to identify stationary clutter from the moving target.

A multiple channel radar receiver may be implemented using multiple antennae, each antenna typically comprising a separate reflector excited by a feedhorn. This approach has several disadvantages, one being that the antenna directivity is limited to that of each individual antenna and not that implied by the physical span of the collective multiple antennae. Another disadvantage is that the phase center separation is mechanically fixed which also fixes the constant phase beamwidths. Finally, the system noise temperature increases linearly with the number of mismatched antenna apertures.

FIG. 1. shows an alternative approach where a single reflector antenna 100 is coupled to two feedhorns 102 and 104. feedhorns 102 and 104 are inclined at an angle to the centerline 106 of the reflector 100 thus establishing a pair of separated phase centers 110 and 112 at the antenna aperture 114. The separation increases with inclination angle of the feedhorns 102 and 104 to centerline 106.

The antenna configuration shown in FIG. 1 also suffers from several disadvantages. For maximum gain, the phase center of each of the feedhorns 102 and 104 should be at the focus 108 of reflector 100, but this is obviously impossible and hence a loss of antenna gain in the resulting radiation beam patterns must be suffered. Where more than two phase centers are required the problem is further exaggerated. Another disadvantage is that close placement of the feedhorns 102 and 104 commonly results in mutual coupling which may affect receiver discrimination. Furthermore, since MTI relies to a great extent on channel homogeneity the, the driving network for the feedhorns becomes increasingly complex requiring the provision of facilities for the calibration of the multiple beams. Yet another disadvantage is that, again, the phase center separation can only be changed by mechanical means. Furthermore for radar antenna that require rotation at high angular velocity, the added mass and pointing stability may also become an issue.

Accordingly there is a need for an antenna system that mitigates some of the above disadvantages.

SUMMARY OF THE INVENTION

The invention provides a method and apparatus for establishing multiple phase centers for a reflector antenna by using only a single multimode feedhorn.

One aspect of the present invention provides a method for extracting a received radiation beam from a feedhorn by separating the received radiation beam into least two higher order modes and combining the higher order modes in accordance with a weighting such that at least two separated phase centers are established.

Another aspect of the present invention provides a feedhorn for a multiple phase center reflector antenna. The feedhorn has a horn section for receiving a beam and at least two ports coupled to the horn section, each port for extracting a higher order mode such that the beam is received via at least two separated phase centers.

The invention is advantageous in that there is a minimal loss of gain in the beam pattern over that for a comparative single phase center antenna. Another advantage is that the phase center separation and constant phase beamwidths may be adjusted by adjusting the drive parameters. A further advantages arises from the fact that the multiple phase centers are extracted from a single physical aperture which is intrinsically matched, thus reducing the overall system noise temperature. Yet another advantage is that the invention may be easily adapted to provide an antenna responsive to different polarizations.

Advantageously the invention allows an antenna to be operated with a single phase center for a transmission and multiple phase centers for a reception without any substantial increase in complexity.

Additional advantages and features of the invention will become apparent from the description which follows and may be realized by means of the instrumentalities and combinations particularly pointed out in the appended claims.

BRIEF DESCRIPTION OF THE DRAWINGS

Embodiments of the present invention will now be described by way of example only with reference to the following drawings in which:

FIG. 3-A to 3-C are a series of graphical depictions of the combination of the E-field in the feedhorn shown in FIG. 2;

FIG. 4 is a schematic view of a dual phase center antenna in accordance with an embodiment of the invention;

FIG. 5 is a graphical depiction of phase center separation and antenna gain for a series of differing amplitude ratios;

FIG. 6-A is a graphical depiction of the antenna gain pattern for $TE_{11}$ excitation of the feedhorn of FIG. 2;

FIG. 6-B is a graphical depiction of the antenna phase for $TE_{11}$ excitation of the feedhorn of FIG. 2;

FIG. 6-C is a graphical depiction of the antenna gain pattern for excitation of the feedhorn of FIG. 2 in both the $TE_{11}$ and the $TE_{21}$ modes according to the weight $0.6.TE_{11}+0.4.j.TE_{21}$;

FIG. 6-D is a graphical depiction of the antenna phase for excitation of the feedhorn of FIG. 2 in both the $TE_{11}$ and the $TE_{21}$ modes according to the weight $0.6.TE_{11}+0.4.j.TE_{21}$;

FIG. 7-A is a perspective view of a feedhorn for horizontal polarization; and FIG. 7-B is a perspective view of probe used to receive the $TM_{01}$ mode in the feedhorn shown in FIG. 7-A.

DETAILED DESCRIPTION OF THE PREFERRED EMBODIMENTS

For an understanding of the invention, reference will now be made by way of example to a following detailed description in conjunction with the accompanying drawings in which like numerals refer to like structures.

Figure 1:
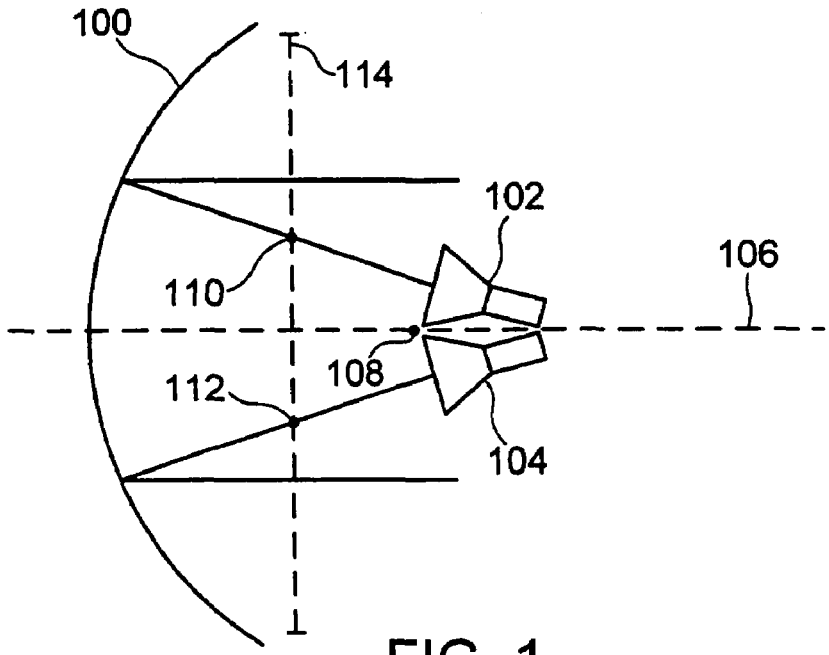
FIG. 1 PRIOR ART
FIG. 1 is a schematic view of a prior art dual phase center antenna.
Figure 2:
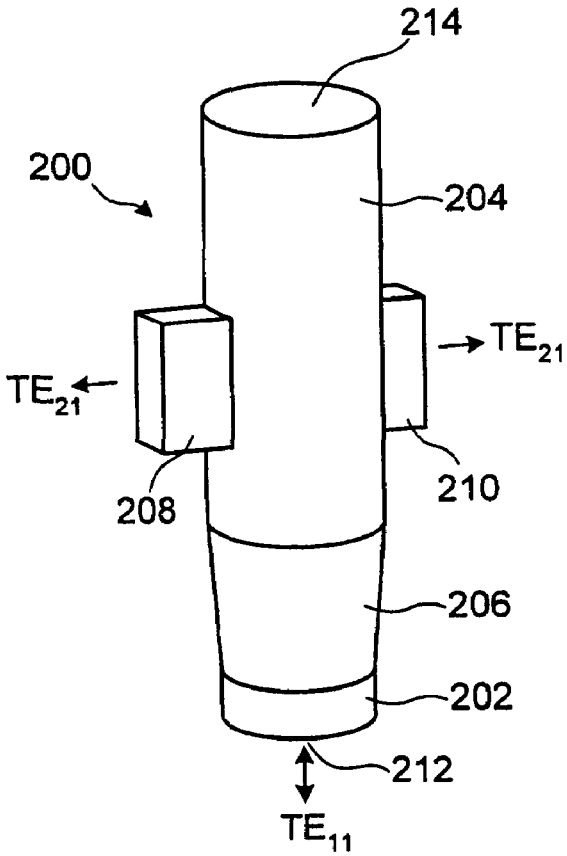
FIG. 2 is a perspective view of a multimode feedhorn for vertical polarization.

In accordance with a first embodiment of the invention, FIG. 2 shows a multimode feedhorn 200 comprising a lower circular waveguide 202 and a circular waveguide horn section 204 joined by a tapered waveguide section 206. A pair of rectangular waveguides 208 and 210 are transversely connected to opposite sides of the feedhorn 204. The diameter of waveguide 202 is selected such that, at the design frequency, only the dominant $TE_{11}$ mode is able to propagate. The diameter of the horn section 204 is chosen such that a $TE_{21}$ secondary mode is able to co-exist with the $TE_{11}$ mode.

The $TE_{11}$ mode is extracted via port 212 and the $TE_{21}$ mode is symmetrically extracted via transversely located waveguides 208 and 210. Feedhorn 200 also includes an opening 214. The desired phase center separation is achieved by assigning amplitude and phase weightings to the $TE_{11}$ and $TE_{21}$ modes in accordance with a pair of complex weights. The complex weights define a power ratio and relative phase between the modes and may be written as:

$$\left.\begin{array}{l} a\cdot TE_{11}+b\cdot TE_{21} \\ a\cdot TE_{11}-b\cdot TE_{21} \end{array}\right\} \qquad \text{Equation 1}$$

where a and b are complex numbers.

FIG. 3-A is a graph of gain vs. angle for the $TE_{11}$ E-field of feedhorn 200. Similarly FIG. 3-B is a graph of gain vs. angle for the $TE_{21}$ E-field. The resultant E-field gain patterns for two different combinations of the $TE_{11}$ and the $TE_{21}$ modes are graphed in FIG. 3-C. The curve 300 represents the combination of the modes according to the weight:

$$0.5.TE_{11}+0.5TE_{21}.$$

Curve 300 is symmetrical around 0° indicating that for a simple in-phase combination of the $TE_{11}$ and the $TE_{21}$, there is no phase center separation. Curve 302 depicts the combination of modes according to a complex weight:

$$0.5.TE_{11}+j0.5TE_{21},$$

i.e. pattern 302 depicts a combination of modes where the $TE_{21}$ mode is of equal in power, but out of phase by 90°, with respect to the $TE_{11}$ mode. Curve 302 indicates that the peak angular gain of the feedhorn moves away from 0° when the modes are out of phase. In the case shown, the phase center is angularly shifted to point 304. In general while it is optimal that the $TE_{11}$ and $TE_{21}$ modes be 90° out of phase, phase center separation may also be achieved for phase differences other than 90°.

Note that for a second complex weight:

$$0.5.TE_{11}-j0.5TE_{21},$$

pattern 302 will be symmetrically displaced to the opposite side of the 0° point creating a second angularly shifted phase center (not shown).

In one embodiment received modes $TE_{11}$ and the $TE_{21}$ are extracted via feedhorn 200. Each of the complex weights in Equation 1, when applied to the amplitude of the received modes, yields a separate phase center. Conveniently, in an embodiment of the present invention the complex weights may be algorithmically assigned by a software or hardware controller thus removing the need for any mechanical or electrical adjustments to establish a particular phase center separation. Furthermore, the complex weights may be selected for a particular set of application dependent criteria. For example in MTI radar applications it is desirable to maximize both the phase center separation and the constant phase beam width, while simultaneously minimizing losses in the antenna gain relative to the conventional reflector antenna. Other applications may require different criteria and hence different complex weights.

FIG. 4 shows an antenna system comprising a multimode feedhorn 200 and a reflector antenna 100. Feedhorn 200 is coupled via waveguides 410, 412 and 414 to a duplexer 416. Waveguide 414 couples the $TE_{11}$ mode port to circular waveguide section 202 for both transmit and receive operations. Waveguides 410 and 412 are only operative during a receive operation when they extract the $TE_{21}$ component from received radiation beams 400 and 402. Duplexer 416 is also operative to connect the transmitter 418 and the receiver 420 to the feedhorn according to synchronization signals supplied by a timer 422. The focus of the reflector 100 is at or near point 108.

In a receive operation feedhorn 200 establishes two laterally displaced phase centers according to complex weights assigned by duplexer 416. Essentially this implies that two separated beams 400 and 402 are received. Phase centers 404 and 406 are laterally displaced from the conventional $TE_{11}$ radiator phase center 110 by a distance d as indicated in the figure. The separation between phase centers 404 and 406 is thus 2*d* and this separation increases as the power in the $TE_{21}$ mode is increased relative to the power in the $TE_{11}$ mode as graphically depicted in FIG. 5 (for a 90° phase difference between the modes). As can be seen from the graph, the phase centers are initially co-incident (the separation is zero) when no power provided to the $TE_{21}$ mode. The phase centers separate with increasing $TE_{21}$ power until at equal power (when the ratio is 0.5/0.5) the separation is approximately 15 cm. Note that with increasing phase center separation there is a slight reduction in the antenna gain (<5 dB at equal power) indicating that a compromise may need to be established between gain and phase center separation.

FIG. 6-A is a gain plot for conventional single $TE_{11}$ mode excitation and FIG. 6-B is a corresponding phase plot. FIG. 6-C is a gain plot for a multimode extraction of $TE_{11}$ and $TE_{21}$ modes according to the weight $0.6.TE_{11}+0.4.j.TE_{21}$. Again, FIG. 6-D is the corresponding phase plot. The multimode gain pattern (FIG. 6-C) is only slightly altered from the single mode pattern in FIG. 6-A, with some of the gain shifting into the side lobes 600. For MTI where constant phase beam width is an important parameter, the actual location of the phase center is taken as the point where the constant phase beam width is maximum. This point is indicated at 602 on the phase plot of FIG. 6-D and as can be seen from FIG. 6-B and FIG. 6-D, the constant phase beam width is not significantly compromised for the multimode case.

Antenna reciprocity dictates that the antenna system characteristics are essentially the same regardless of whether an antenna is transmitting or receiving electromagnetic energy. Accordingly, reciprocity allows most radar and communications systems to operate with only one antenna. For an MTI radar it is advantageous to transmit only the $TE_{11}$ mode i.e. the $TE_{21}$ mode is not excited during transmission. A single phase center $TE_{11}$ radiation beam is thus transmitted from the phase center at 110 in FIG. 4. However in the receive mode, the reflected beams are received by feedhorn 200 which separates out $TE_{11}$ and $TE_{21}$ modes into waveguides 202 and 208/210 respectively. By combining the $TE_{11}$ and $TE_{21}$ modes in accordance with a predetermined complex weight the antenna, in receive mode, has two apparent phase centers at 404 and 406.

The feedhorn 200 shown in FIG. 4 results in a vertically polarized radiation pattern with the E-field oriented orthogonal to the plane of the page. In another embodiment shown in FIG. 7-A, the resultant radiation pattern is horizontally polarized. Horizontal polarization may have some advantages in specific applications, such as maritime surveillance, where its use reduces the false alarm rate due to sea clutter.

In FIG. 7-A, a horizontally polarized feedhorn 700 comprises a circular a waveguide 702 and a circular waveguide horn section 704 joined by a tapered section 706. A rectangular waveguide 708 is connected the side of circular waveguide 702. The rectangular waveguide propagates the $TE_{11}$ mode. Waveguide 702 is dimensioned to also propagate the $TM_{01}$ mode, which has an axial electric field distribution. In this embodiment the $TM_{01}$ mode is excited by a coaxial probe 710.

The coaxial probe 710 is shown in more detail in FIG. 7-B. Probe 710 comprises a metal cone 712 which is coupled to a coaxial conductor 714. The coaxial conductor comprises a central conductor 716 and an outer conductor 718. The metal cone 712 is connected to the central conductor 716.

In an alternative embodiment the interior volume of feedhorns 200 and 700 may be filled with a dielectric material, enabling the reduction of the physical size of these elements.

The feedhorn embodiments described in relation to FIG. 2 and FIG. 7-A both establish a pair of separated phase centers when appropriately driven. To establish more than two phase centers, the feedhorns need to be excited by additional TE or TM modes. For example, by selecting feedhorn dimensions to permit a $TE_{11}$, a $TE_{21}$ and a $TM_{01}$ mode to propagate, a triple phase center antenna gain pattern may be established.

The reflector antenna 100 in FIG. 4 may be any type of reflector including a dual reflector like a Cassegrain or Gregorian type. A Cassegrain antenna utilizes a hyperbolic sub-reflector to intercept reflected waves before their normal focal point and re-reflect them back to a rear mounted feedhorn. The Gregorian antenna differs from the Cassegrain in that the hyperbolic sub-reflector is replaced by an elliptical sub-reflector allowing use at longer wavelengths. Practically, the separated phase centers are realized by receiving beams via a reflector antenna and focusing these beams into a multimode feedhorn. However the reflector part of the antenna is not necessarily altered, the change being made to the feedhorn in order to allow multiple modes to propagate therein. Accordingly, many different types of reflector may be used to couple the beams to the multimode feedhorn, and the selection of an appropriate complex weight will establish a particular phase center separation for the combination of feedhorn and receiving reflector.

As will be apparent to those skilled in the art in light of the foregoing disclosure, many alterations and modifications are possible in the practice of this invention without departing from the spirit or scope thereof.

What is claimed is:

1. A feedhorn for a multiple phase center reflector antenna, the feedhorn comprising:

a horn section for receiving a beam;

at least two ports coupled to the horn section, each port for extracting a different mode; and a controller for receiving the different modes from said at least two ports and for combining the different modes using a pre-determined complex weighting so as to produce at least two different separated phase centers, said at least two ports comprising a $TE_{11}$ port for coupling a $TE_{11}$ mode and a $TE_{21}$ port for coupling a $TE_{21}$ mode.

2. A feedhorn according to claim 1, wherein the feedhorn is responsive to a polarization that is orthogonal to the direction of the phase center separation.

3. A feedhorn according to claim 1, wherein the $TE_{11}$ port is a circular waveguide dimensioned such that only the $TE_{11}$ mode propagates therein.

4. A feedhorn according to claim 1, wherein the $TE_{21}$ port comprises a pair of opposing rectangular waveguides transversely located on the horn section, each of the rectangular guides being dimensioned to propagate the $TE_{21}$ mode therein.

5. A feedhorn according to claim 1, wherein the horn section is dimensioned such that only the $TE_{11}$ and the $TE_{21}$ modes are able to propagate therein.

* * * * *